US005729028A

United States Patent [19]

Rose

[11] Patent Number: 5,729,028

[45] Date of Patent: Mar. 17, 1998

[54] ION ACCELERATOR FOR USE IN ION IMPLANTER

[76] Inventor: Peter H. Rose, 89 Phillips Ave., Rockport, Mass. 01966

[21] Appl. No.: 789,629

[22] Filed: Jan. 27, 1997

[51] Int. Cl.[6] ..... H01J 23/10

[52] U.S. Cl. ..... 250/492.21; 250/423 R; 250/396 R

[58] Field of Search ..... 250/492.21, 492.2, 250/423 R, 251, 396 R

[56] References Cited

U.S. PATENT DOCUMENTS

| | | | |
|---|---|---|---|
| 2,206,558 | 7/1940 | Bennett . | |
| 3,136,908 | 6/1964 | Weinman | 250/423 R |
| 3,395,302 | 7/1968 | Brown, Jr. et al. | 250/423 R |
| 3,683,287 | 8/1972 | Miessner | 250/423 R |
| 3,786,359 | 1/1974 | King | 250/423 R |
| 3,956,634 | 5/1976 | Tran et al. | 250/396 R |
| 5,300,891 | 4/1994 | Tokoro | 250/251 |

OTHER PUBLICATIONS

P.H. Rose, "The Three–Stage Tandem Accelerator", Nucl. Instr. and Methods, vol. 11, No. 1, pp. 49–62, 1961. (No Month).

Gordon et al., "High Intensity Source of 20–keV Hydrogen Atoms", Rev. Sci. Inst., vol. 34, No. 9, pp. 963–970, 1963. (No Month).

Wittkower et al., "Injection of Intense Neutral Beams into a Tandem Accelerator", Rev. Sci. Inst., vol. 35, No. 1, pp. 1–11, 1964. (No Month).

P.H. Rose, "The production of Intense Neutral and Negative Ion Beams", Nucl. Instr. and Methods, vol. 28, No. 1, pp. 146–153, 1964. No Month.

Rose et al., "The Tandem as a Heavy Ion Accelerator", IEEE–Trans. Nuc. Sci. vol. NS–12. No. 3, pp. 251–256, 1965. No Month.

Wittkower et al., "Equilibrium–Charge State Distributions of Energetic Ions (Z>1) In Gaseous and Solid Media", Atomic Data vol. 5, No. 2, pp. 113–166, 1973. No Month.

P.H. Rose, "Implantation at Energies Above 150keV", Nucl. Instr. and Methods, B35, pp. 535–540, 1988. No Month.

K.H. Purser, "A High Throughput $^{14}C$ Accelerator Mass Spectrometer", Radiocarbon, vol. 34, No. 3, pp. 458–467, 1992. No Month.

O'Connor et al., "Performance characteristics of the Genus Inc. 1510 high energy ion implantation system", Nucl. Instr. and Methods, B74, pp. 18–26, 1993. No Month.

Adam et al., "Zeitschrift für Ingenieure aller Fachrichtungen" Kerntechnik, Istopentechnik Und–Chemie, Packard Instrument International SA, Jun. 1962.

*Primary Examiner*—Keit T. Nguyen

*Attorney, Agent, or Firm*—Samuels, Gauthier, Stevens & Reppert

[57] ABSTRACT

An ion accelerator for use in an ion beam implanter. The accelerator forms milliampere beams of heavy ions such as boron and phosphorous in a configuration in which the terminal ion source is replaced by a neutral beam injector. The neutral beam is formed at ground by the conversion of a focused beam of positive ions to neutral ions in a charge exchange canal. The neutral beam so formed is stripped of one or more electrons in a gas or vapor filled canal in the high voltage terminal. A 180° analyzing magnet located in the high voltage terminal analyzes and directs a selected charge state to an acceleration tube parallel to the neutral beam injection tube where the selected positive ions are accelerated to ground potential. To extend the energy range of the accelerator below the injection energy, a high voltage insulator is provided to insulate the ground end of the positive ion acceleration tube permitting the acceleration tube and terminal to be uniformly biased at a negative voltage to decelerate the beam to very low energies at a location close to the point of use. An accelerator assembly includes a 90° analyzing magnet in the high voltage terminal.

22 Claims, 4 Drawing Sheets

ION ACCELERATOR FOR USE IN ION IMPLANTER

BACKGROUND OF THE INVENTION

Ion implantation, the process of modifying materials by the injection of fast atoms, is widely used during the process of semiconductor fabrication. Conventional processes employ ions of species such as boron (p-type dopant), and phosphorous and arsenic (n-type dopants) to dope semiconductor material. These dopants are commonly implanted into wafers cut from single crystals of silicon or gallium arsenide. The design and performance of ion implanter apparatus developed for the semiconductor industry is widely described in the literature, for example, in the "Proceedings of the Tenth International Conference on Ion Implantation Technology", Catania, Italy, Jun. 13–17, 1994.

The evolution of ion implantation equipment is driven by the needs of the semiconductor industry. Ion implanter manufacturers are constantly looking for ways to improve the equipment and to find new opportunities as the market changes and grows. The segment of the implanter market that is predicted to grow at the fastest rate in the near future, is the market for high energy-500 keV to several MeV-implanters.

An implanter designed to provide good wafer throughput over a wide energy range up to the highest energies required, will find many applications and have a distinct advantage in the marketplace. One successful example of a machine of this type is the linear accelerator (linac) developed by Eaton Corporation, and described in P. H. Rose, "Implantation at Energies Above 150 keV", Nucl. Instr. and Methods, B35, pp. 535–540, 1988. This machine is usable between about 50 kilovolts and several megavolts and is the dominant high energy ion implanter in the world today. Unfortunately these machines are costly, have a large footprint, consume a lot of power (50 kW), and consequently have a high cost of ownership.

A second example of a high energy ion implanter is the tandem accelerator. The tandem accelerator is also widely used by the semiconductor industry. In a tandem accelerator, negative ions are injected into a high voltage terminal at a positive potential where they are changed from negative to positive ions by stripping electrons in a foil or gas canal. The positive ions are then accelerated back to ground potential. The tandem accelerator was originally described in U.S. Pat. No. 2,206,558 issued to Bennett, incorporated herein by reference. The patent shows a machine in which negative ions, after stripping to positive ions, are analyzed by a 180° magnet in a high voltage terminal and accelerated to ground in an acceleration tube which is configured alongside the negative ion acceleration tube. A machine of this type was never actually built. Terminal analysis was not needed because the hydrogen ions accelerated, and used for nuclear research, have only one positive charge state.

The first commercially available tandem accelerators, built in 1958, were large horizontal machines with the negative ion tube in line with the positive ion tube, as described in R. J. Van de Graaff, "Tandem Electrostatic Accelerators", Proceedings of the 1958 Accelerator Conference, High Voltage Engineering Corporation, Cambridge, Mass. 1958. Three stage tandems have been built in which neutral beams injected into the first of two tandem accelerators were charge exchanged to negative hydrogen ions in the terminal of the first high voltage tandem, and accelerated to ground potential. The 6 to 9 MeV negative ions produced were then injected into a second conventional negative ion to positive ion tandem accelerator. The three stage machines, of which two were built, produced higher energies than any single machine which was important to nuclear physics at the time these machines were built. This method of acceleration which was proposed by R. J. Van de Graaff in 1958, was not limited to light ions only, and is described in more detail in P. H. Rose, "The Three-Stage Tandem Accelerator", Nucl. Instr. and Methods, Vol. 11, pp. 49–62, 1961, Wittkower et al., "Injection of Intense Neutral Beams into a Tandem Accelerator", Rev. Sci. Inst., Vol. 35, pp. 1–11, 1964, and Rose et al., "The Tandem as a Heavy Ion Accelerator", IEEE-Trans. Nuc. Sci. Vol. NS-12. no. 3, pp. 251–256, 1965, all of which are incorporated herein by reference.

The tandem implanters utilized in the semiconductor industry have also been described in the literature, for example, K. H. Purser, "A High Throughput $^{14}C$ Accelerator Mass Spectrometer", Radiocarbon, Vol. 34, No. 3, pp. 458–467, 1992. Tandem accelerators for semiconductor applications produce beams with energies up to about 3 MeV. The terminal potential is consequently only 1 to 2 megavolts, because doubly or triply charged ions can be used to give the higher energies. The art of creating beams of negative ions, including those used in semiconductor processing, accelerating them and stripping or converting them to positive ions is described in, for example, P. H. Rose, "The production of Intense Neutral and Negative Ion Beams", Nucl. Instr. and Methods, Vol. 28, pp. 146–153, 1964, and O'Connor et al., "Performance characteristics of the Genus Inc. 1510 high energy ion implantation system", Nucl. Instr. and Methods, B74, pp. 18–26, 1993, both of which are incorporated herein by reference.

The tandem accelerator used as an implanter has a number of shortcomings which have, so far, made it less competitive than the linac in the marketplace. It is more difficult to produce negative ions than it is to produce positive ions. In fact, usually a positive ion beam is first produced, and then converted into negative ions by charge exchange with a substantial loss (90–96%) of the initial positive ion beam current. In the high voltage terminal, the stripping process produces many different positive charge states, and unless there is analysis in the terminal, all the beams of different charge state must be accelerated in the positive ion acceleration tube. Even though only one of these beams can be used for implantation, the extra current drain in the high voltage acceleration tube and on the high voltage power supply limits the beam current available for implantation.

A more subtle disadvantage of the tandem accelerator is that to vary the energy of the desired beam, the voltage on the positive terminal is changed. The negative ions arriving in the terminal are consequently stripped at different energies and the relative yields of the different positive ion charge states changes. This complication can make machine setup over a wide range of energies difficult. In the positive ion accelerator tube, the existence of so many ion charge states increases the probability of contamination of the selected beam because of charge exchange in the gas of the high voltage acceleration tube and in the drift regions. The additional beam currents contribute, therefore, to an increase in the background gas pressure and to the contamination.

SUMMARY OF THE INVENTION

The invention substantially eliminates the disadvantages of the prior art tandem accelerator by injecting neutral instead of negative ions at a fixed energy and by providing analysis in the high voltage terminal.

In accordance with the invention, there is provided an apparatus for the formation of milliampere beams of heavy ions such as Boron and Phosphorous in which the terminal ion source is replaced by a neutral beam injector. The neutral beam is formed at ground by the conversion of a focused beam of positive ions to neutrals in a charge exchange canal. The neutral beam so formed is stripped of one or more electrons in a gas or vapor filled canal in the high voltage terminal. A 180° analyzing magnet located in the high voltage terminal analyses and directs a selected charge state to an acceleration tube parallel to the neutral beam injection tube where the selected positive ions are accelerated to ground potential. To extend the energy range of the accelerator below the injection energy, a means is provided to insulate the ground end of the positive ion acceleration tube permitting the acceleration tube and terminal to be uniformly biased at a negative voltage to decelerate the beam to very low energies at a location close to the point of use.

DETAILED DESCRIPTION OF THE ILLUSTRATED EMBODIMENTS

Figure 1:
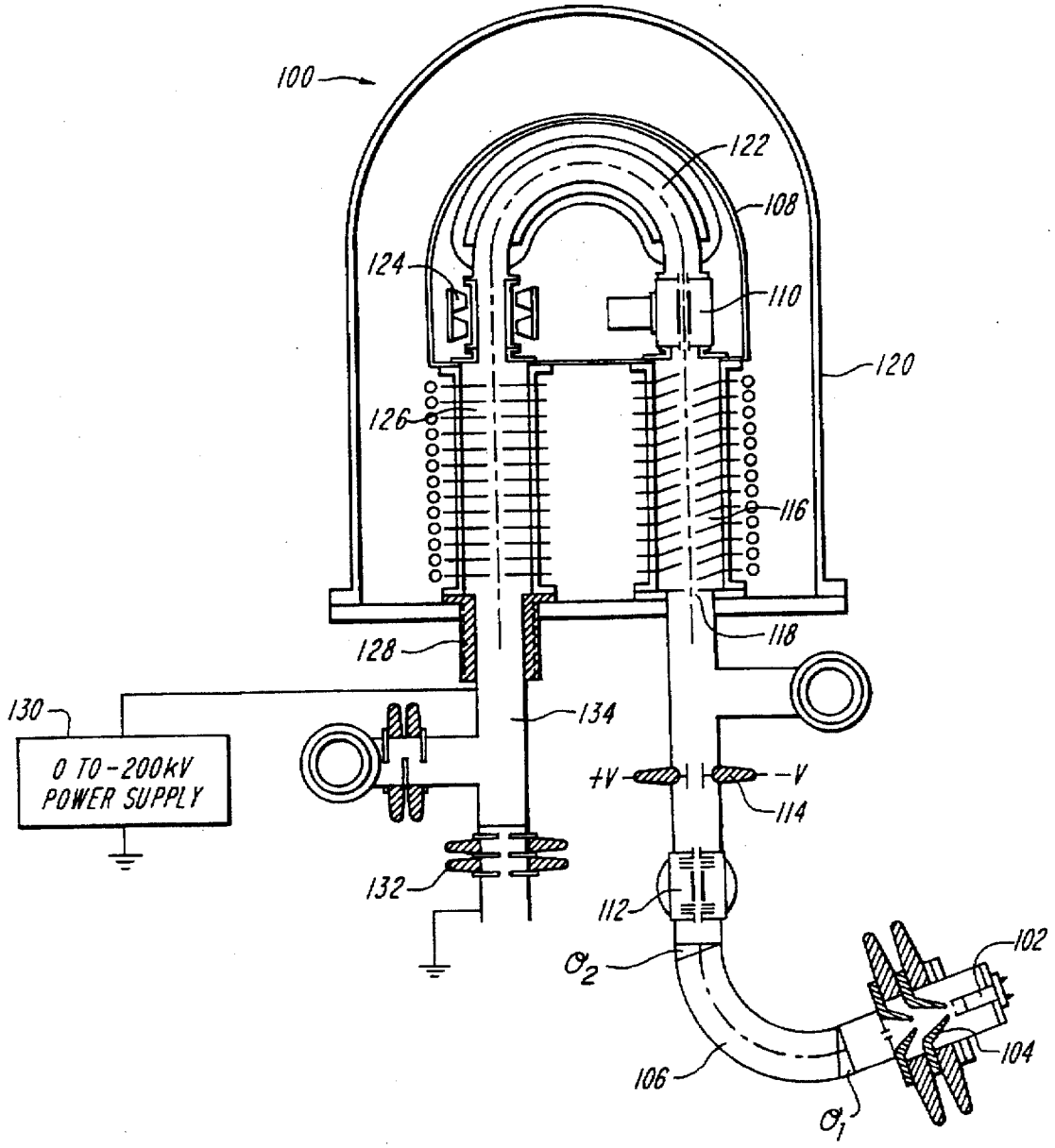
FIG. 1 is a schematic diagram of an exemplary ion accelerator for use in an ion beam implanter in accordance with the invention.

With reference to FIG. 1, a schematic diagram of an exemplary ion accelerator 100 for use in an ion beam implanter 100 in accordance with the invention is shown. The accelerator 100 includes a positive ion source 102 with a circular or slit like aperture producing positive ions such as Boron or Phosphorus. An extraction and acceleration section 104 is provided to accelerate the beam from the ion source to energies between 50 and 250 keV.

Analysis and focusing of the positive ion beam is accomplished with a-dipole magnet 106 or a multipole lens so that the maximum amount beam current enters a stripper canal 110 in a high voltage terminal 108. An ion neutralizer 112 in the form of a gas or vapor filled canal serves to convert a fraction of the positive ion beam to a neutral beam close to the entrance of the accelerator. The gas or vapor emerging from the canal is pumped by a high vacuum pump (not shown), and the vacuum chamber is provided with baffles to minimize the gas flow into a neutral beam drift region to be described. The neutralizing gas or vapor must be chosen to give efficient conversion from positive ions to neutral atoms. The work described in the previously described O'Connor article shows data indicating that conversion efficiencies above 70% can be obtained using magnesium vapor. Electrostatic deflection plates 114 are provided to dump the unwanted positive and negative ion beams emerging from the neutralizer before they can enter an inclined field neutral beam high voltage drift tube 116 of an accelerator assembly 120.

The accelerator assembly includes a baffle assembly 118 that prevents scattered or unfocused beams or beam components close to the analyzed beam from entering the neutral beam high voltage drift tube 116. The drift tube 116 serves to transport the neutral beam, maintained at a high vacuum of $\sim 10^{-6}$ Torr.

The one or two stage differentially pumped stripper canal 110 is provided with a gas recirculation feature which serves to reduce gas leakage to the drift tube 116 or the high voltage terminal 108. The stripper canal operates to convert a fraction of the neutral beam to positive ions of various charge states in the terminal. With reference to Table 4.2 of the compilation of charge exchange fractions of fast ions in gases and vapors described in Wittkower et al., "Equilibrium-Charge State Distributions of Energetic Ions (Z>1) In Gaseous and Solid Media", Atomic Data 5, pp. 113–166, 1973, incorporated herein by reference, it will be appreciated that helium would be an efficient stripping medium, giving for example about 60% conversion to $B^+$ and 20% to $B^{2+}$.

A 180° analyzing magnet 122 selects the desired charge state (i.e. $1^+$, $2^+$, $3^+$, etc.) from the beams emerging from the stripper canal 110. These beams will have the energy of the injected positive ion beam prior to neutralization.

An electrostatic or magnetic multipole lens 124 adjusts the focus of the beam emerging from the magnet 122. A positive ion acceleration tube 126 accelerates the emerging positive ion beam to ground potential.

A high voltage insulator 128 or bushing allows the acceleration tube 126, the terminal 108 and a drift tube 134 to be raised to a negative potential by a power supply 130. In this way, the injected beam can be decelerated to a lower energy in a deceleration region 132 outside the accelerator 120. By these means, the beam is transported at high energy as far as possible to minimize space charge blow up, the deceleration being as close to the target as possible.

Accordingly, the invention includes a novel combination of an injector in which a focused positive ion beam is converted by charge exchange into a directed beam of fast neutral atoms. The neutral beam is directed through the inclined field neutral beam tube 116 to the high voltage terminal 108 containing the stripper canal 110, which converts most of the neutral beam to positive ions. The high voltage terminal contains the 180° analyzing magnet 122 just beyond the stripper canal which selects one positive charge state from among those emerging from the stripper canal and directs the beam selected by analysis down the positive ion acceleration tube 126 with an axis parallel to the axis of the inclined field neutral beam drift tube 116.

The implanter of the invention comprises an ion accelerator which utilizes neutral beam injection with 180° terminal analysis rather than the negative hydrogen ion injection of conventional accelerators. The positive ion acceleration tube 126 accelerates the analyzed beam to ground potential giving a final energy $E_f$, $$E_f = E_i + V_T q$$

where $E_i$ is the injection energy and $V_T q$ is the energy imparted by the accelerator and is equal to the terminal voltage, $V_T$ times the charge state, q of the beam selected by the 180° analyzing magnet.

By varying the terminal potential from zero to some positive voltage which may be as high as two megavolts, the beam energy can be varied from the injection energy to several megavolts depending upon the charge state. The useful working energy of this accelerator configuration is extended below the injection energy by insulating the ground end of the positive ion acceleration tube from the encapsulating pressure vessel with the insulator 128. Application of a negative voltage to the connecting drift tube 134, the acceleration tube 126 and the terminal 108 by a negative voltage from the power supply 130, permits the positive ion beam to travel at the full injection energy until it reaches the deceleration gap 132, which may be located close to the point of use of the beam. In this manner, space charge blow up of the beam is greatly reduced by transporting the beam as far as possible at the full injection energy.

Figure 2:
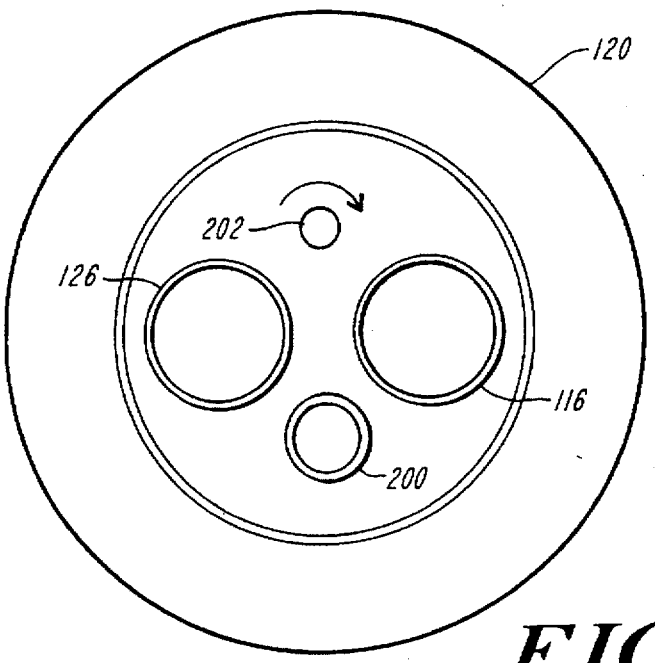
FIG. 2 is cross-sectional view of the accelerator assembly of the ion accelerator of FIG. 1 taken along line 2—2.

FIG. 2 is a cross-sectional view of the accelerator assembly 120 taken along line 2—2 of FIG. 1. FIG. 2 shows the location of the neutral 116 and positive 126 ion beam high voltage tubes, a high voltage 5—15 kW, preferably 10 kW, power supply 200, and a rotating shaft 202 used to power a terminal generator. A preferred embodiment in the case of a horizontal accelerator would be to mount the tubes one above the other.

Figure 3:
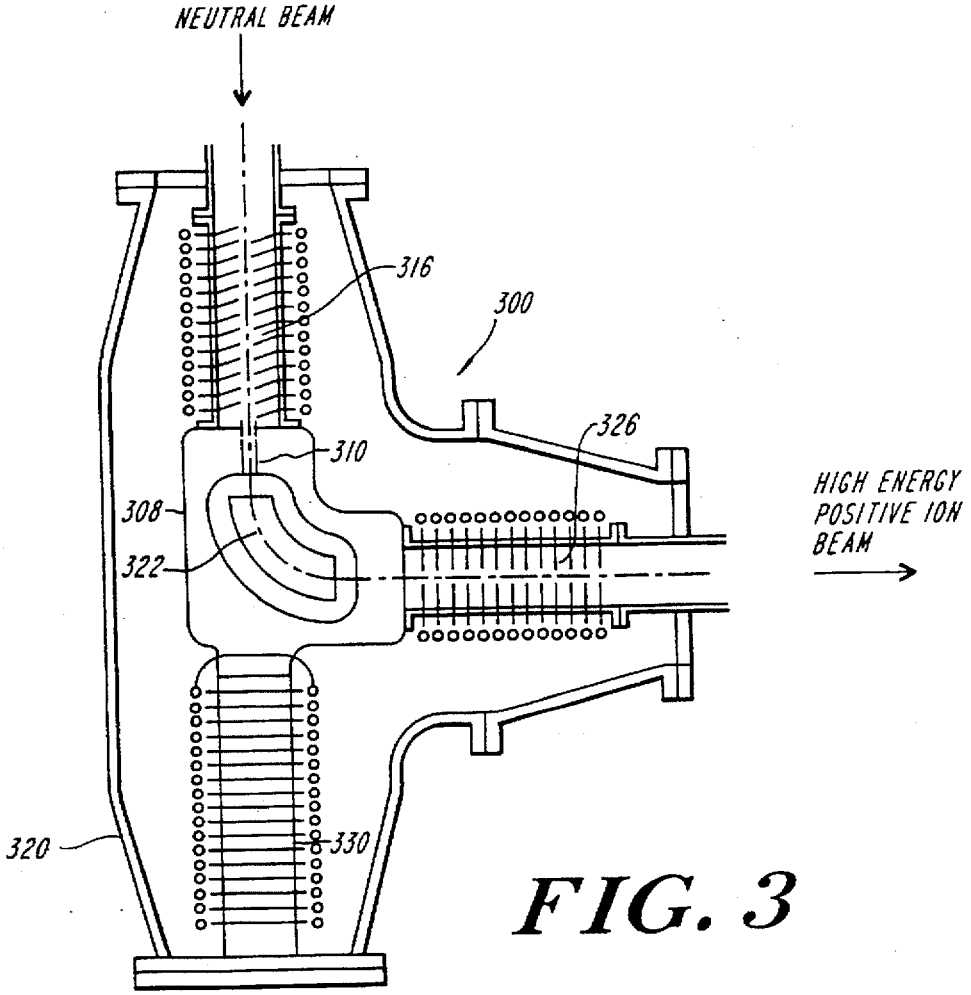
FIG. 3 is a schematic block diagram of an alternative embodiment of an ion accelerator in accordance with the invention.

FIG. 3 is a schematic block diagram of an alternative embodiment of an ion accelerator 300 in accordance with the invention. The accelerator 300 includes an accelerator assembly having an inclined field neutral beam high voltage drift tube 316 and an ion stripper canal 310. The illustrated configuration allows for the use of a 90° analyzing magnet 322 in a high voltage terminal 308. Such an arrangement allows for a power supply 330 to be separate from the drift tube 316 and a positive ion acceleration tube 326, and would provide easy access to the terminal after removing the power supply.

Accordingly, a neutral ion beam is initially provided to the drift tube 316. The positive ions from the neutral beam stripper canal 310 are analyzed by the 90° magnet 322 and accelerated to ground by the acceleration tube 326 at 90° to the neutral beam tube 316. The resultant beam from the acceleration tube 326 is a high energy positive ion beam.

An important and essential component of the invention is the heavy atom neutral beam injector. A neutral beam injector for hydrogen was presented in the previously described article of Wittkower et al., Rev. Sci. Inst., Vol. 35, pp. 1–11, 1964, in which a solenoid is used as a focusing element. A possible modification of this is to replace the solenoid with a quadrupole or multipole lens which would be preferable for focusing heavy ions. An in-line lens of this type gives limited mass separation, but could be used successfully in the accelerator embodiments described herein, because of the excellent terminal analysis provided and because of the tolerance of the neutral beam tube to unfocused beams.

A preferred embodiment would be to use a dipole magnet to provide the focusing, such as the magnet 106 of FIG. 1. Such a magnet can be designed to provide a distortion free image by pole shaping and strong focusing elements incorporated in the magnet. A system of this type has been described for hydrogen ions by Gordon et al., "High Intensity Source of 20 -keV Hydrogen Atoms", Rev. Sci. Inst., Vol. 34, p 963–970, 1963, incorporated herein by reference. The positive ion source of the Gordon et al. system is inside the magnet. This configuration would not be practical for energies above about 60 keV, and in any case requires a magnet with a large gap to contain the ion source.

In the exemplary embodiment of FIG. 1, the ion source 102 is located outside the magnet, and the acceleration section 104 to the full injection energy between 50 and 400 keV, preferable 200 keV, occurs close to the ion source before the dipole focusing element 106. An alternative embodiment would involve extracting the beam at approximately 60 keV, and accelerate after the magnet dipole focusing element. However, this configuration would require the magnet and power supply to be at voltage.

Figure 4:
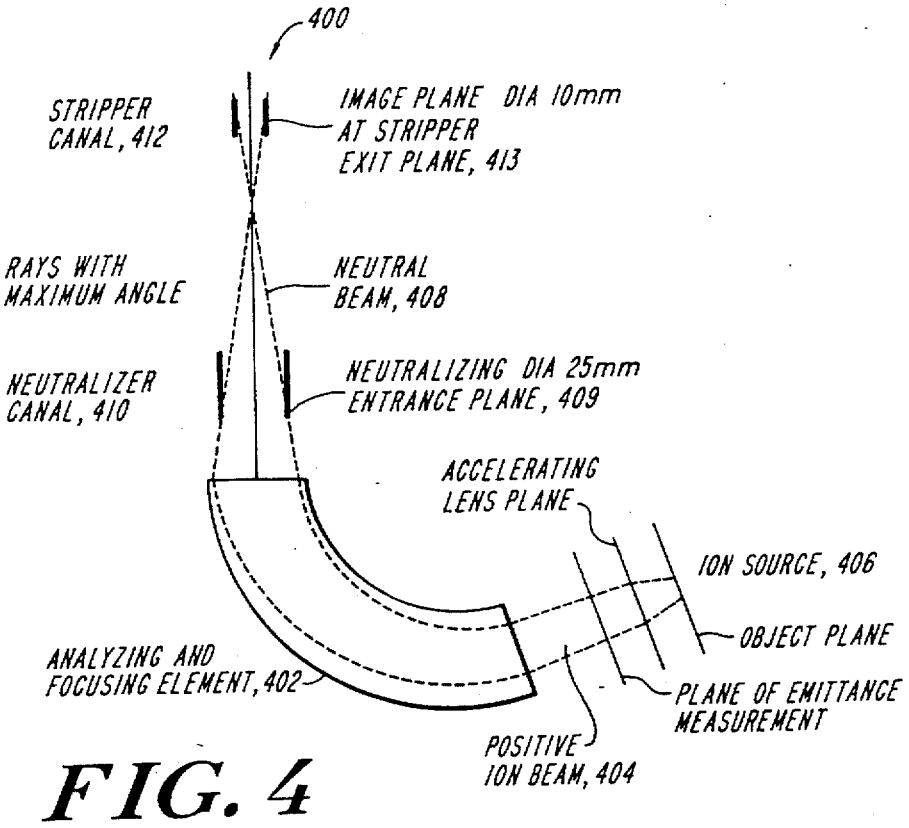
FIG. 4 is a schematic block diagram of a simple optical system using a dipole magnet to focus a cylindrically symmetric positive ion beam.

The optical requirements of the injection are best illustrated by an example. FIG. 4 shows a schematic block diagram of a simple optical system 400 using a dipole magnet 402 to focus a cylindrically symmetric positive ion beam 404 from an ion source 406 with a circular extraction aperture. The ion source has associated therewith an object plane, an accelerating lens plane, and a plane of emittance measurement. The resultant neutral beam passes through a neutralizer canal 410 and continues through a stripper canal 412.

The optics of the slit beam are similar but complicated by the need to consider focusing in the direction parallel to the slit axis and in the orthogonal direction across the short dimension of the slit. The differences are well understood by those skilled in the art and the computer code transport catalog number SLAC-91 associated with the Stanford Linear Accelerator, incorporated herein by reference, is one of the tools available for design of both cylindrically symmetric systems and the slit shaped beams often used in ion implanters. A simple dipole magnet imaging system can be designed with shaped entrance and exit poles to provide vertical focusing and aberration correction. For example, H. A. Enge in Volume II of the book "Focusing of Charged Particles" edited by A. Septier and published by Academic Press, New York in 1969, incorporated herein by reference, describes how this can be achieved.

Figure 5:
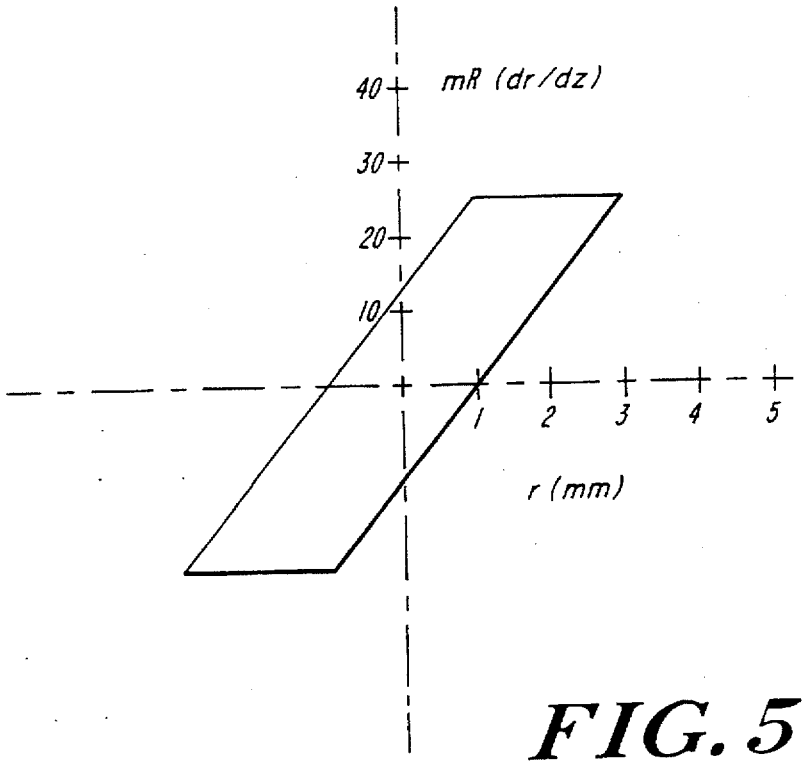
FIG. 5 is a graph of an idealized emittance of a divergent ion beam before it enters the dipole magnet and acceleration section of the invention.

A carefully designed ion source can produce a low emittance beam of the desired ion species, e.g. boron or phosphorus, measured in a field free region just beyond the acceleration stage of 100 mm mrad at an energy of 200 keV. FIG. 5 shows a graph of such an idealized emittance of the divergent ion beam before it enters the dipole magnet and acceleration section (e=100 mm mrad). The focusing action of the dipole deflection magnet, must match this emittance to the acceptance of the neutralizer/stripper. An example of a practical geometry is shown in the optical system 400 of FIG. 4. The distance between the neutralizer entrance plane 409 and the exit plane of the stripper 413, allowing space for the neutral beam inclined field tube and vacuum pumps and the charged beam dump 114, is 200 cm.

Figure 6:
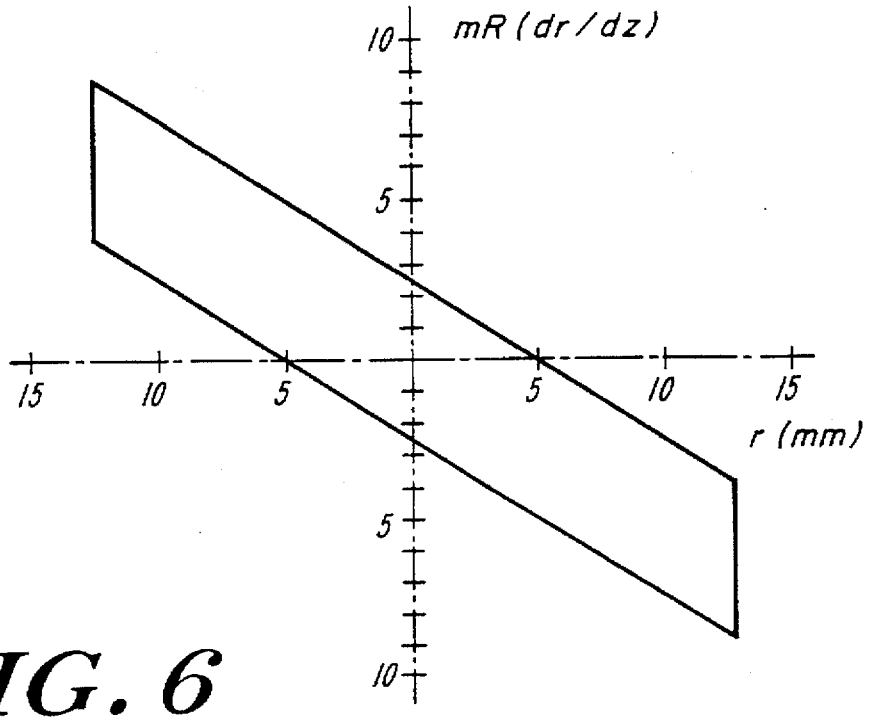
FIG. 6 is a graph of the geometric acceptance of the invention at the entrance plane of the neutralizer canal.
Figure 7:
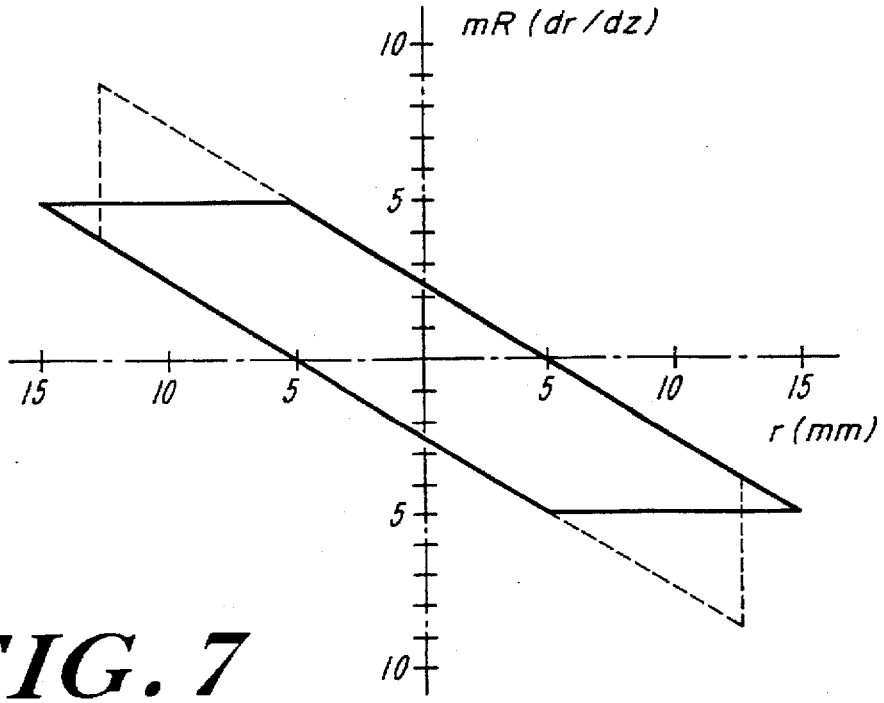
FIG. 7 is a graph of the beam emittance superimposed on the acceptance of the invention after the dipole imaging lens.

The geometric acceptance of the system at the entrance plane 409 of the neutralizer canal 410 is given in the graph of FIG. 6 (a=125 mm mrad). The dipole magnet lens 106, or other selected lens, must change the shape of the emittance of the ion beam so that it fits inside the acceptance area. In the illustrated example, if a magnification of 5 is chosen, it will be appreciated that the emittance of the positive ion beam, almost fits inside the acceptance of the neutral beam transport system as is shown in the graph of FIG. 7, where the beam emittance is superimposed on the acceptance of the system after the dipole imaging lens. This result-assumes there are no aberrations which distort the emittance of the beam, and no allowance has been made for scattering which can amount to 1 to 2 mrad. A lower magnification would cause beam to be lost by excess divergence and a higher magnification would produce a beam image larger than the stripper canal opening.

A dipole magnet with the correct first order properties can be calculated using this information and the methods described by H. A. Enge presented above. Choosing a radius of 30 cm, an ion source object distance of 30 cm is required and a dipole magnet entrance shim angle of $\theta_1=32°$, and an exit shim angle of $\theta_2=25.5°$. The magnetic field requirement for 200 keV boron is 7 kgauss.

The foregoing description has been set forth to illustrate the invention and is not intended to be limiting. Since modifications of the described embodiments incorporating the spirit and substance of the invention may occur to persons skilled in the art, the scope of the invention should be limited solely with reference to the appended claims and equivalents thereof.

What is claimed is:

1. An ion accelerator, comprising:

a neutral ion beam injector assembly for generating a neutral ion beam; and a high voltage terminal containing:

a high voltage neutral beam tube which receives said neutral ion beam from said injector assembly;

a beam converter for receiving said neutral ion beam from said neutral beam tube and converting portions of said neutral ion beam to beams of positive ions;

a charge state selector directly connected to said beam converter for selecting a beam of a single charge state from said beams of positive ions emerging from said beam converter; and a high voltage acceleration tube directly connected to said charge state selector for accelerating said single charge state beam to ground potential.

2. The ion accelerator of claim 1 further comprising a drift tube coupled to said acceleration tube for decelerating said beam emerging from said accelerator tube by applying a negative biasing voltage.

3. The ion accelerator of claim 2 further comprising a negative high voltage power supply electrically connected to said acceleration tube.

4. The ion accelerator of claim 2 further comprising an electrical insulator coupled to a ground end of said acceleration tube for insulating said acceleration tube from ground.

5. The ion accelerator of claim 1, wherein said neutral ion beam comprises fast neutral ions.

6. The ion accelerator of claim 1, wherein said beam emerging from said acceleration tube comprises heavy ions.

7. The ion accelerator of claim 1, wherein said neutral ion beam injector assembly comprises:

a positive ion beam source for producing a positive ion beam;

means for extracting and accelerating said positive ion beam;

means for analyzing and focusing said positive ion beam; and means for converting a portion of said positive ion beam into said neutral ion beam.

8. The ion accelerator of claim 7, wherein said neutral ion beam injector assembly further comprises means for preventing scattered or unfocused beams from entering said neutral beam tube.

9. The ion accelerator of claim 1, wherein said charge state selector comprises a 180° analyzing magnet.

10. The ion accelerator of claim 9, wherein said neutral beam tube and said accelerator tube have parallel axes.

11. The ion accelerator of claim 1, wherein said charge state selector comprises a 90° analyzing magnet.

12. The ion accelerator of claim 11, wherein said neutral beam tube and said accelerator tube have orthogonal axes.

13. An ion accelerator for accelerating heavy ions used in a semiconductor ion beam implanter, comprising:

a neutral ion beam injector assembly for generating a neutral ion beam of fast neutral atoms;

a high voltage terminal containing:

a high voltage neutral beam tube which receives said neutral ion beam from said injector assembly, a stripper canal for receiving said neutral ion beam from said neutral beam tube and converting portions of said neutral ion beam to beams of positive ions, a sector analyzing magnet directly connected to said stripper canal for selecting a beam of a single charge state from said beams of said positive ions emerging from said stripper canal, and a high voltage acceleration tube directly connected to said sector analyzing magnet for accelerating said single charge state beam to ground potential;

an electrical insulator coupled to a ground end of said acceleration tube for insulating said acceleration tube from ground;

a negative high voltage power supply electrically connected to said acceleration tube; and adrift tube coupled to said acceleration tube for decelerating said beam emerging from said accelerator tube by applying a negative biasing voltage.

14. The ion accelerator of claim 13, wherein said neutral ion beam injector assembly comprises:

a positive ion beam source for producing a positive ion beam;

a single sector dipole magnet; and a neutralizing canal.

15. The ion accelerator of claim 14, wherein said neutral ion beam injector assembly further comprises electrostatic deflection plates and a baffle to prevent undesired beams from entering said neutral beam tube.

16. The ion accelerator of claim 13, wherein said analyzing magnet comprises a 180° analyzing magnet.

17. The ion accelerator of claim 16, wherein said neutral beam tube and said accelerator tube have parallel axes.

18. The ion accelerator of claim 13, wherein said analyzing magnet comprises a 90° analyzing magnet.

19. The ion accelerator of claim 18, wherein said neutral beam tube and said accelerator tube have orthogonal axes.

20. The ion accelerator of claim 13, wherein said high voltage terminal comprises a 5–15 kW power supply.

21. The ion accelerator of claim 13, wherein said negative high voltage power supply comprises a 0 to −200 kV power supply.

22. A method of accelerating ions, comprising:

generating a neutral ion beam;

converting portions of said neutral ion beam to beams of positive ions within a high voltage terminal;

selecting a beam of a single charge state from said beams of positive ions by a charge state selector contained within said high voltage terminal; and accelerating said single charge state beam to ground potential by a high voltage acceleration tube directly connected to said charge state selector and contained within said high voltage terminal.

* * * * *